US011409214B2

(12) United States Patent
Kume et al.

(10) Patent No.: US 11,409,214 B2
(45) Date of Patent: Aug. 9, 2022

(54) FIXING APPARATUS AND IMAGE FORMING APPARATUS

(71) Applicant: CANON KABUSHIKI KAISHA, Tokyo (JP)

(72) Inventors: Takao Kume, Kanagawa (JP); Masahito Omata, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/382,614

(22) Filed: Jul. 22, 2021

(65) Prior Publication Data

US 2022/0043380 A1 Feb. 10, 2022

(30) Foreign Application Priority Data

Aug. 4, 2020 (JP) ..... JP2020-132529

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
CPC ..... G03G 15/2028; G03G 15/2053; G03G 15/2064; G03G 2215/2038
See application file for complete search history.

(56) References Cited

U.S. PATENT DOCUMENTS

| | | | | |
|---|---|---|---|---|
| 8,472,835 | B2 | 6/2013 | Suzuki | |
| 9,244,405 | B2 | 1/2016 | Maruyama | |
| 2015/0093163 | A1* | 4/2015 | Maruyama | G03G 15/2053 399/329 |
| 2015/0093165 | A1* | 4/2015 | Kondo | G03G 15/2028 399/329 |

FOREIGN PATENT DOCUMENTS

| | | | |
|---|---|---|---|
| JP | 2011170239 | A | 9/2011 |
| JP | 2015069006 | A | 4/2015 |
| JP | 2015069007 | A | 4/2015 |
| JP | 2017125935 | A | 7/2017 |

* cited by examiner

*Primary Examiner* — Hoang X Ngo
(74) *Attorney, Agent, or Firm* — Rossi, Kimms & McDowell LLP

(57) ABSTRACT

A fixing apparatus includes an endless first rotary member, a second rotary member configured to form a nip portion, and a nip member configured to be rubbed against the first rotary member via lubricant, and being configured to receive radiant heat from a heating element and heat the nip portion. The nip member involves a nip forming portion configured to be in contact with the first rotary member, and an extending portion formed continuously with a downstream edge portion of the nip forming portion. The extending portion involves a holding portion configured to hold the lubricant. The holding portion is longer than the second rotary member and shorter than the first rotary member, and when viewed in a sheet conveyance direction, both end portions of the holding portion are position outside of end portions of the second rotary member and inside of end portions of the first rotary member.

10 Claims, 10 Drawing Sheets

FIXING APPARATUS AND IMAGE FORMING APPARATUS

BACKGROUND OF THE INVENTION

Field of the Invention

The present invention relates to a fixing apparatus that fixes a toner image to a sheet, and an image forming apparatus that includes the fixing apparatus.

Description of the Related Art

Image forming apparatuses include a fixing apparatus that applies heat and pressure to a sheet on which a toner image is formed, and thereby fixes the toner image to the sheet. The fixing apparatus proposed in the conventional art includes an endless fixing belt, a roller (referred to as a pressing roller), a halogen lamp, a nip member, a reflective plate, and a stay. The pressing roller is in contact with the outer circumferential surface of the fixing belt.

In an apparatus described in Japanese Patent Application Publication No. 2011-170239, the halogen lamp is disposed inside the fixing belt so that the rotating fixing belt is heated by the radiant heat from the halogen lamp. The nip member is disposed such that the fixing belt is nipped by the nip member and the pressing roller, and that the nip member is rubbed against the inner circumferential surface of the fixing belt. When a sheet on which a toner image is formed passes through a fixing nip portion formed between the fixing belt and the pressing roller, heat and pressure are applied to the sheet, and the toner image is fixed to the sheet. The reflective plate surrounds the nip member for reflecting the radiant heat from the halogen lamp, toward the nip member. The reflective plate and the nip member are held by the stay.

For reducing the frictional resistance between the fixing belt and the nip member, viscous lubricant such as grease is applied onto the inner circumferential surface of the fixing belt. The viscosity of the lubricant decreases when the lubricant is heated. Thus, in a conventional apparatus, when an inner circumferential surface of the fixing belt passes through the fixing nip portion, part of the lubricant on the inner circumferential surface of the fixing belt may separate from the inner circumferential surface of the fixing belt. The separated lubricant may flow on a bent portion of the nip member that is not rubbed against the fixing belt, and may flow to the reflective plate and adhere to the same. If the lubricant adheres to the reflective plate, it becomes difficult to cause the radiant heat from the halogen lamp to efficiently heat the fixing belt.

SUMMARY OF THE INVENTION

According to one aspect of the present invention, a fixing apparatus includes an endless first rotary member, a heating element disposed inside the first rotary member, a second rotary member configured to be in contact with an outer circumferential surface of the first rotary member, the second rotary member and the first rotary member being configured to form a nip portion through which a sheet is conveyed while nipped by the first rotary member and the second rotary member, a nip member configured to be rubbed against an inner circumferential surface of the first rotary member via lubricant such that the first rotary member is nipped by the nip member and the second rotary member, the nip member being configured to receive radiant heat from the heating element and heat the nip portion, and a reflective plate formed so as to surround the heating element when viewed in a rotation-axis direction of the second rotary member, and configured to reflect the radiant heat from the heating element, toward the nip member, wherein the nip member comprises a nip forming portion configured to be in contact with the first rotary member, and an extending portion formed continuously with a downstream edge portion of the nip forming portion in a sheet conveyance direction in the nip portion and configured not to be in contact with the first rotary member, wherein the extending portion comprises a holding portion configured to hold the lubricant, wherein the first rotary member is longer than the second rotary member in the rotation-axis direction, and wherein the holding portion is longer than the second rotary member and shorter than the first rotary member in the rotation-axis direction, and when viewed in the sheet conveyance direction, both end portions of the holding portion are position outside of end portions of the second rotary member and inside of end portions of the first rotary member.

Further features of the present invention will become apparent from the following description of exemplary embodiments with reference to the attached drawings.

DESCRIPTION OF THE EMBODIMENTS

First Embodiment

Image Forming Apparatus

Figure 1:
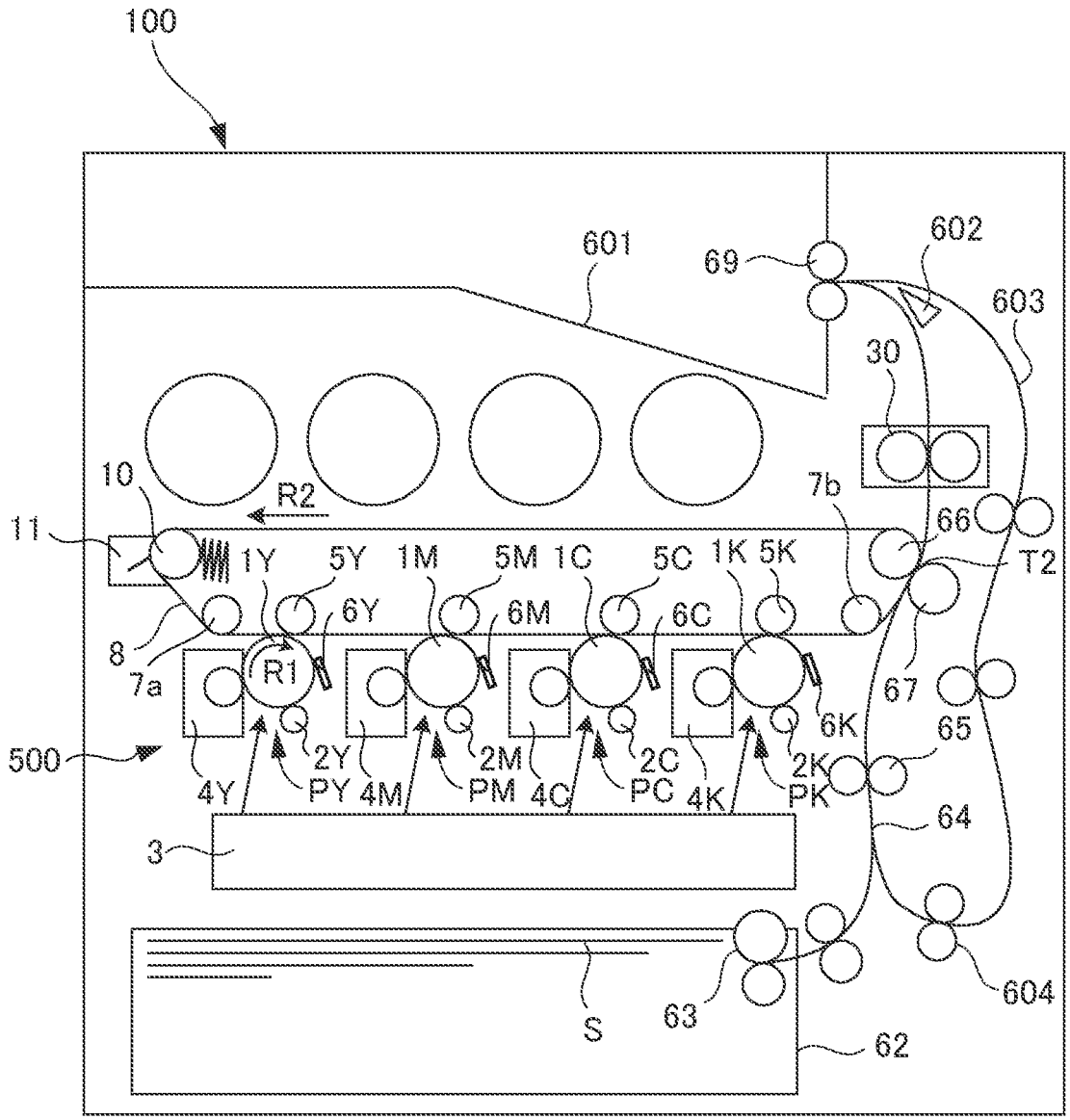
FIG. 1 is a schematic diagram illustrating a configuration of an image forming apparatus of the present embodiment.

Hereinafter, the present embodiment will be described. First, a configuration of an image forming apparatus of the present embodiment will be described with reference to FIG. 1. An image forming apparatus 100 illustrated in FIG. 1 is a full-color printer having an intermediate-transfer tandem system. Specifically, the image forming apparatus 100 includes a plurality of image forming portions PY, PM, PC, and PK, disposed along an intermediate transfer belt 8. The image forming portions PY, PM, PC, and PK respectively correspond to yellow, magenta, cyan, and black.

The image forming apparatus 100 forms an image on a sheet S in accordance with the image information sent from a document reading apparatus (not illustrate) connected to an apparatus body, or from an external apparatus (not illustrated), such as a personal computer, communicatively connected to the apparatus body. The sheet S may be of various sheet materials including a paper sheet, a plastic film, and a cloth sheet. The paper sheet may be a plain paper sheet, a thick paper sheet, a rough paper sheet, an embossed paper sheet, or a coated paper sheet. In the present embodiment, the image forming apparatus 100 includes an image forming unit 500 that forms a toner image on the sheet S. The image forming unit 500 includes the image forming portions PY to PK, primary transfer rollers 5Y to 5K, the intermediate transfer belt 8, a secondary transfer inner roller 66, and a secondary transfer outer roller 67.

Next, a conveyance process for the sheet S will be described. For example, the sheet S is stacked in a cassette 62, and fed to a conveyance path 64, one by one, by a sheet feeding roller 63 at an image forming timing. In another case, the sheet S is stacked on a manual feed tray (not illustrated), and fed to the conveyance path 64 one by one. The sheet S is conveyed to a registration roller 65 disposed on the conveyance path 64, and skew correction and timing correction are performed on the sheet S by the registration roller 65. Then, the sheet S is sent to a secondary transfer portion T2 by the registration roller 65. The secondary transfer portion T2 is a transfer nip portion formed by the secondary transfer inner roller 66 and the secondary transfer outer roller 67, which face each other. In the secondary transfer portion T2, a secondary transfer voltage is applied to the secondary transfer inner roller 66, so that a toner image is secondary-transferred from the intermediate transfer belt 8 onto the sheet S.

In synchronization with the above-described conveyance process for the sheet S performed in a portion from the cassette 62 to the secondary transfer portion T2, an image is sent to the secondary transfer portion T2. An image forming process for the image will be described. First, the image forming portions PY, PM, PC, and PK will be described. Note that the image forming portions PY, PM, PC, and PK have substantially the same configuration except that developing apparatuses 4Y, 4M, 4C, and 4K respectively use toner of yellow, magenta, cyan, and black. Thus, in the following description, the image forming portion PY for yellow will be described as an example, and the description for the other image forming portions PM, PC, and PK will be omitted.

The image forming portion PY mainly includes a photosensitive drum 1Y, a charging apparatus 2Y, the developing apparatus 4Y, and a drum cleaner 6Y. The surface of the rotary photosensitive drum 1Y is uniformly charged by the charging apparatus 2Y, and then an electrostatic latent image is formed on the surface of the photosensitive drum 1Y by an exposure apparatus 3, which is driven in accordance with an image information signal. The electrostatic latent image formed on the photosensitive drum 1Y is then developed into a toner image by the developing apparatus 4Y and visualized. After that, a predetermined pressure and primary transfer bias are applied to the toner image formed on the photosensitive drum 1Y, by a primary transfer roller 5Y disposed so as to face the photosensitive drum 1Y via the intermediate transfer belt 8; and the toner image is primary-transferred onto the intermediate transfer belt 8. Transfer residual toner that is slightly left on the photosensitive drum 1Y after the primary transfer is removed by the drum cleaner 6Y.

The intermediate transfer belt 8 is stretched by and wound around a tension roller 10, the secondary transfer inner roller 66, and stretching rollers 7*a* and 7*b*; and is driven and moved in a direction indicated by an arrow R2 of FIG. 1. In the present embodiment, the secondary transfer inner roller 66 serves also as a driving roller that drives the intermediate transfer belt 8. As described above, the image forming portions PY to PK perform their image forming processes. An image forming process for each color is performed at a timing at which one toner image corresponding to the color is transferred onto another toner image that has been primary-transferred onto the intermediate transfer belt 8 at a position located upstream of the position of the one toner image in the moving direction of the intermediate transfer belt 8. As a result, a full-color toner image is formed on the intermediate transfer belt 8, and conveyed to the secondary transfer portion T2. Transfer residual toner on the intermediate transfer belt 8 left after the sheet has passed through the secondary transfer portion T2 is removed from the intermediate transfer belt 8 by a transfer cleaner apparatus 11.

Thus, the sheet S that has been subjected to the above-described conveyance process and the full-color toner image that has been subjected to the above-described image forming process are sent to the secondary transfer portion T2 at the same timing, and thereby the toner image is secondary-transferred from the intermediate transfer belt 8 onto the sheet S. The sheet S onto which the toner image has been transferred is then conveyed to the fixing apparatus 30. In the fixing apparatus 30, heat and pressure are applied to the toner image, so that the toner image is melted and solidified, that is, fixed to the sheet S. The fixing apparatus 30 of the present embodiment will be described in detail later (see FIG. 2).

When single-side printing is performed, the sheet S to which the toner image has been fixed by the fixing apparatus 30 is discharged onto a sheet discharging tray 601 by a sheet discharging roller 69 that rotates in a forward direction. On the other hand, when double-side printing is performed, the sheet S is conveyed by the sheet discharging roller 69 that rotates in the forward direction, until the trailing edge of the sheet S passes a switching member 602. After that, the sheet discharging roller 69 is rotated in the backward direction; and the sheet S is conveyed to a duplex conveyance path 603, with the trailing edge serving as the leading edge. The sheet S is then sent to the conveyance path 64 again by a sheet refeeding roller 604. Since the conveyance performed after that and the image forming process performed on a second side of the sheet S are the same as those described above, the description thereof will be omitted.

Fixing Apparatus

Figure 2:
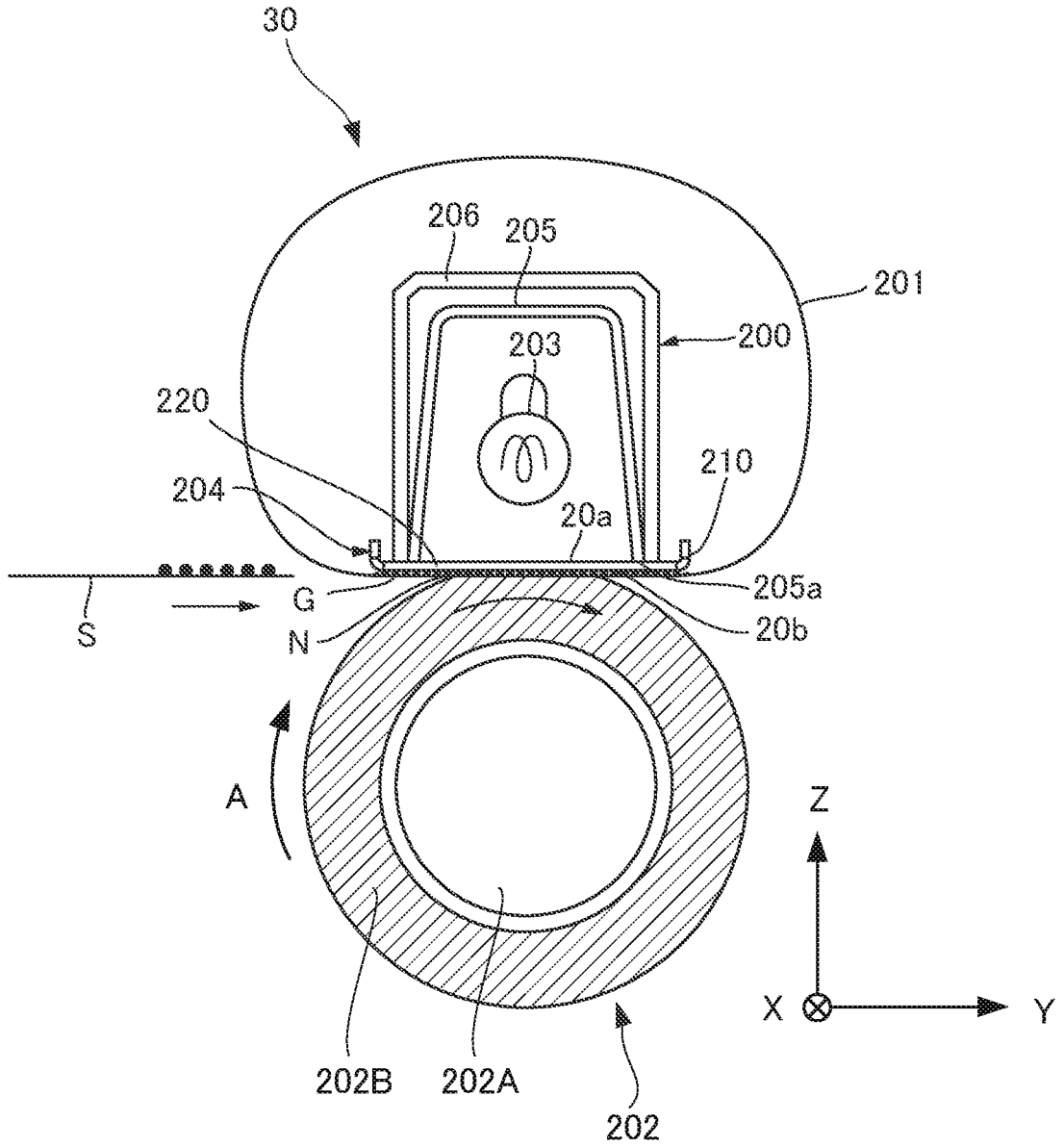
FIG. 2 is a schematic diagram illustrating a fixing apparatus of the present embodiment.

Next, the fixing apparatus 30 of the present embodiment will be described with reference to FIG. 2. As illustrated in FIG. 2, the fixing apparatus 30 includes an endless fixing belt 201, a heating unit 200 that heats the fixing belt 201, and a pressing roller 202. The pressing roller 202 and the heating unit 200 nip the fixing belt 201. Note that the fixing belt 201 described in this specification may be formed like a thin film.

The fixing belt 201 that serves as a first rotary member is an endless belt with flexibility. The fixing belt 201 is made of resin such as polyimide, or metal such as stainless steel, which have high thermal conductivity and small heat capacity. In recent years, the fixing belt 201 made of polyimide resin is often used. The fixing belt 201 is rotatably disposed, and lubricant is applied onto the inner circumferential surface of the fixing belt 201 for ensuring sliding property between the fixing belt 201 and the later-described nip member 204. In addition, guide members (not illustrated) are disposed at both end portions of the fixing belt 201 in the width direction (X direction) of the fixing belt 201, for guiding the fixing belt 201 to rotate and regulating the fixing belt 201 from moving in the width direction.

The heating unit 200 is disposed on the inner circumferential surface side of the fixing belt 201, and includes a halogen lamp 203, the nip member 204, a reflective plate 205, and a stay 206. The halogen lamp 203 serves as a heating element; and is located, separated from the fixing belt 201 and the nip member 204. The halogen lamp 203 generates radiant heat for heating the fixing belt 201. The temperature of the radiant heat generated by the halogen lamp 203 changes in accordance with the amount of power supplied from a power supply (not illustrated). In the present embodiment, the temperature of the radiant heat generated by the halogen lamp 203 is adjusted by a control unit (not illustrated) controlling the amount of power supplied to the halogen lamp 203, such that the temperature of a fixing nip portion N detected by a temperature sensor (not illustrated) is kept at a predetermined target temperature.

The nip member 204 is a long member that is disposed so as not to rotate with respect to the fixing belt 201 that rotates, and that extends in the width direction (i.e., the rotation-axis direction of the pressing roller 202) so as to be rubbed against the inner circumferential surface of the fixing belt 201. For causing the radiant heat from the halogen lamp 203 to efficiently heat the fixing belt 201, the nip member 204 absorbs the radiant heat from the halogen lamp 203, and transmits the radiant heat to the fixing belt 201. The nip member 204 of the present embodiment includes a nip forming portion 220 and a bent portion 210. When viewed in the rotation-axis direction (X direction) of the pressing roller 202, the nip forming portion 220 extends in the sheet conveyance direction (Y direction), along the fixing nip portion N. The bent portion 210 serves as an extending portion. When viewed in the rotation-axis direction of the pressing roller 202, the bent portion 210 is formed continuously with the downstream edge portion of the nip forming portion 220 in the sheet conveyance direction, and extends in a separation direction, so as not to be rubbed against the inner circumferential surface of the fixing belt 201. The separation direction is a direction in which the bent portion 210 extends away from the pressing roller 202. The nip member 204, which includes the nip forming portion 220 and the bent portion 210, may be formed by bending a plate, such as an aluminum plate, that has a thermal conductivity larger than that of the later-described stay 206. Note that the bent portion 210 may be formed also at the upstream edge portion of the nip forming portion 220 in the sheet conveyance direction.

As described above, the halogen lamp 203 generates the radiant heat for heating the fixing belt 201. When the halogen lamp 203 generates the radiant heat, the nip member 204 receives the radiant heat generated by the halogen lamp 203. That is, the nip member 204 includes a surface (referred to as a heat receiving surface 20*a*) that faces the halogen lamp 203 and receives the radiant heat from the halogen lamp 203. For efficiently absorbing the radiant heat from the halogen lamp 203 and transmitting the radiant heat to the fixing belt 201, the heat receiving surface 20*a* is colored so as to have a color close to black, which has high emissivity (radiation factor).

On the other hand, a surface of the nip forming portion 220 that is rubbed against the fixing belt 201 (the surface is referred to as a rubbed surface 20*b* for discriminating the rubbed surface 20*b* from the heat receiving surface 20*a*) is smoothed to reduce the frictional resistance between the fixing belt 201 and the rubbed surface 20*b*. In addition, for reducing the frictional resistance between the fixing belt 201 and the rubbed surface 20*b*, lubricant with high thermal resistance is applied to the whole of the inner circumferential surface of the fixing belt 201. Alternatively, the lubricant may be applied to the rubbed surface 20*b*. In this case, since the fixing belt 201 is rubbed against the rubbed surface 20*b* while rotated, the frictional resistance between the fixing belt 201 and the rubbed surface 20*b* is reduced, as in the case where the lubricant is applied to the whole of the inner circumferential surface of the fixing belt 201. The lubricant used has viscosity that changes less in a relatively wide temperature range, and may be fluorine grease, fluorine oil, or silicone oil.

The reflective plate 205 reflects the radiant heat generated by the halogen lamp 203, toward the nip member 204. The reflective plate 205 is disposed, separated from the halogen lamp 203 such that the halogen lamp 203 is surrounded by the reflective plate 205 and the nip member 204 when viewed in the rotation-axis direction (X direction) of the pressing roller 202. Thus, the reflective plate 205 is formed by bending a plate (e.g., aluminum plate) with high reflectivity to infrared and far-infrared rays (i.e., radiant heat), such that the plate has a substantially U-shaped cross section as illustrated in FIG. 2. Since the radiant heat from the halogen lamp 203 is directed to the nip member 204 by the reflective plate 205, the radiant heat from the halogen lamp 203 can be efficiently used and the fixing belt 201 can be quickly heated by the radiant heat, via the nip member 204.

The above-described nip member 204 and reflective plate 205 are held by the stay 206. The fixing belt 201 is pressed by the nip member 204 held by the stay 206, from the inside toward the pressing roller 202, so that the fixing nip portion N is formed reliably. The stay 206 is made of a metal, such as stainless steel or spring steel, that has rigidity higher than that of the nip member 204. In addition, when viewed in the rotation-axis direction (X direction) of the pressing roller 202, the stay 206 has a substantially U-shaped cross section so as to surround the reflective plate 205.

Note that in the present embodiment, the nip member 204 and the reflective plate 205 are held by the stay 206 such that the reflective plate 205 is disposed upstream of the bent portion 210 of the nip member 204 in the sheet conveyance direction. Preferably, the nip member 204 and the reflective plate 205 are held by the stay 206 in a state where a contact portion 205*a* of the reflective plate 205 is in contact with the nip member 204.

The pressing roller 202 is rotatably disposed. The pressing roller 202 is rotated by a driving motor (not illustrated) at a predetermined circumferential speed, in a direction indicated by an arrow A. When the pressing roller 202 rotates, the rotational force of the pressing roller 202 is transmitted to the fixing belt 201 by the frictional force produced in the fixing nip portion N. In this manner, the fixing belt 201 is rotated by the rotation of the pressing roller 202. The pressing roller 202 includes a core metal 202A and a roller portion 202B. The core metal 202A serves as a rotation shaft, and the roller portion 202B serves as a second rotary member. The roller portion 202B is formed on the outer circumferential surface of the core metal 202A, and includes an elastic layer and a release layer formed on the outer circumferential surface of the elastic layer. For example, the elastic layer is made of silicone rubber, and the release layer is made of fluororesin such as PTFE, PFA, or FEP. Note that both end portions of the core metal 202A in the rotation-axis direction (X direction) of the pressing roller 202 are rotatably supported by shaft bearing portions (not illustrated).

In the present embodiment, the pressing roller 202 is urged by an urging mechanism (not illustrated), such as springs, toward the fixing belt 201. Specifically, the pressing roller 202 is urged by a predetermined urging force via the shaft bearing portions (not illustrated). Thus, the fixing belt 201 and the pressing roller 202 (more specifically, the roller portion 202B) are brought into pressure contact with each other by a desired pressure contact force. When the fixing belt 201 and the pressing roller 202 are brought into pressure contact with each other, the fixing nip portion N is formed between the fixing belt 201 and the pressing roller 202. In the fixing nip portion N, a toner image is heated and fixed to a sheet S while the sheet S passes through the fixing nip portion N in a state where the sheet S is pressed between the fixing belt 201 and the pressing roller 202. Note that the nip member 204 may be urged toward the pressing roller 202 by the stay 206 that holds the nip member 204 and the reflective plate 205 and that is urged by springs or the like, for forming the fixing nip portion N.

As described above, the nip member 204 is heated by the radiant heat generated by the halogen lamp 203 and the radiant heat reflected by the reflective plate 205, so that the temperature of the fixing belt 201 increases. The sheet S on which a toner image is formed is heated and pressed in the fixing nip portion N while the sheet S is nipped and conveyed by the rotating fixing belt 201 and pressing roller 202, so that the toner image is fixed to the sheet S.

Figure 10:
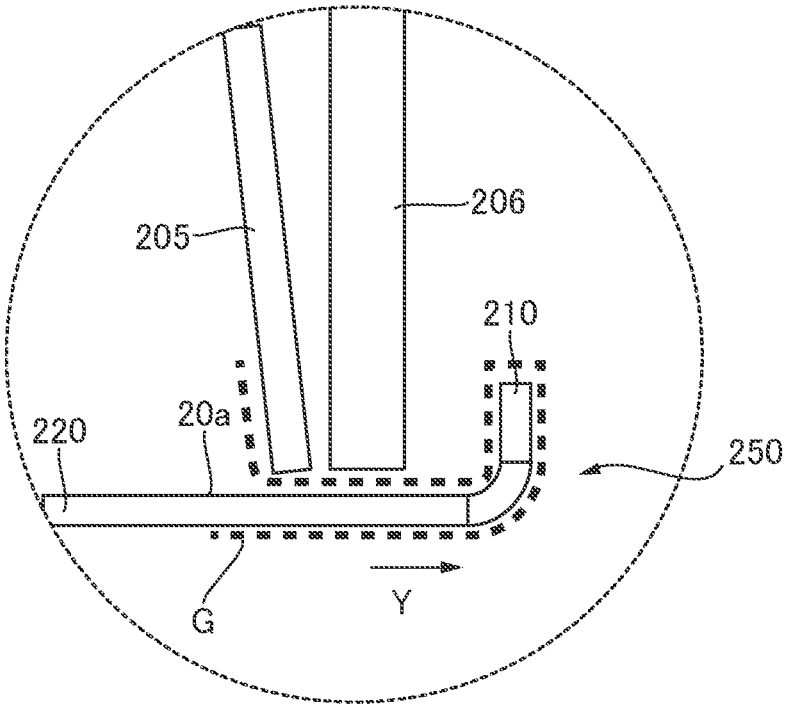
FIG. 10 is a diagram illustrating a flow of lubricant in a conventional art.

By the way, when the lubricant G used for reducing the frictional resistance between the fixing belt 201 and the nip member 204 is heated, the viscosity of the lubricant G decreases, increasing the sliding property between the fixing belt 201 and the nip member 204. In the conventional apparatus, however, since the lubricant G is heated when passing through the fixing nip portion N, the viscosity of the lubricant G is decreased, and the lubricant G may adhere to the reflective plate 205, possibly preventing the radiant heat from the halogen lamp 203 from efficiently heating the fixing belt 201. Hereinafter, a flow of the lubricant G that adheres to the reflective plate 205 in the conventional apparatus will be described with reference to FIG. 10. FIG. 10 is a diagram illustrating the flow of the lubricant G in the conventional apparatus that uses a conventional nip member 250.

As illustrated in FIG. 10, also in the conventional apparatus, the nip member 250 and the reflective plate 205 are held by the stay 206. In addition, the nip member 250 includes the nip forming portion 220 and the bent portion 210. When the viscosity of the lubricant G decreases, the lubricant G is flowed by the rotating fixing belt 201 (see FIG. 2), downstream in the sheet conveyance direction (indicated by an arrow Y) along the nip member 250. In this case, part of the lubricant G may separate from the inner circumferential surface of the fixing belt 201 and flow on the bent portion 210. If the amount of the lubricant G that flows on the bent portion 210 increases, the lubricant G flows around the leading edge of the bent portion 210 and reaches the heat receiving surface 20*a*. On the heat receiving surface 20*a* side of the nip member 250, the reflective plate 205 and the nip member 204 are held by the stay 206. Thus, the lubricant G that has reached the heat receiving surface 20*a* may adhere to the reflective plate 205. If the lubricant G adheres to the reflective plate 205, it becomes difficult to cause the radiant heat from the above-described halogen lamp 203 illustrated in FIG. 2 to efficiently heat the fixing belt 201.

If the reflective plate 205 is separated significantly from the nip member 250 and held by the stay 206, it is possible to prevent the lubricant G from adhering to the reflective plate 205 even if the lubricant G reaches the heat receiving surface 20*a*. In this case, however, a large part of the heat receiving surface 20*a* may be covered with the lubricant G. As a result, the radiant heat from the halogen lamp 203 cannot be used effectively, and it will become difficult to efficiently heat the fixing belt 201. In addition, if the reflective plate 205 is separated significantly from the nip member 250, the radiant heat easily escapes from between the nip member 250 and the reflective plate 205, and does not efficiently heat the fixing belt 201. Thus, it is preferable that the gap between the reflective plate 205 and the nip member 250 is made as narrow as possible. Furthermore, for downsizing the heating unit 200, it is preferable that the reflective plate 205 is in contact with the nip member 250 (see the contact portion 205*a* of FIG. 2), without being separated significantly from the nip member 250.

Thus, in the present embodiment, even if the viscosity of the lubricant G decreases, and part of the lubricant G that flows along the nip member 250 separates from the inner circumferential surface of the fixing belt 201 and flows on the bent portion 210, the lubricant G hardly reaches the heat receiving surface 20*a*. If the lubricant G does not reach the heat receiving surface 20*a*, the lubricant G does not adhere to the reflective plate 205 and the heat receiving surface 20*a*. Hereinafter, the nip member 204 of the present embodiment that can suppress the lubricant G from adhering to the reflective plate 205 and the heat receiving surface 20*a* will be described with reference to FIG. 2 and FIGS. 3 to 7. Note that in FIG. 5, the nip member 204 is separated outward from the fixing belt 201 for ease of understanding the description.

Nip Member

Figure 3:
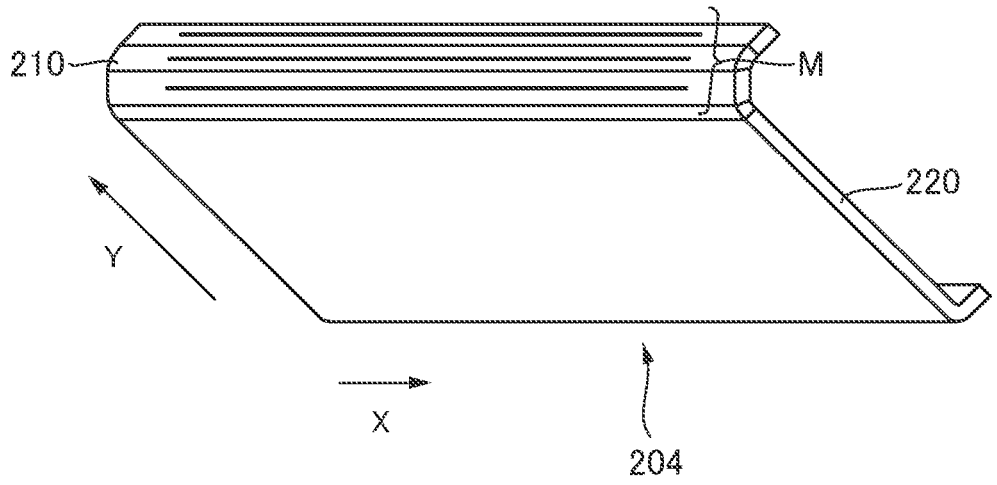
FIG. 3 is a perspective view illustrating a nip member of a first embodiment.
Figure 4:
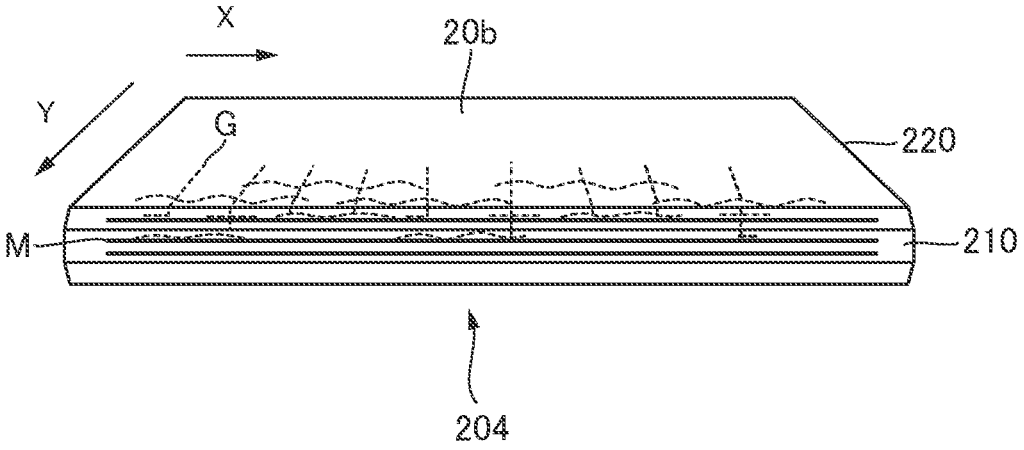
FIG. 4 is a perspective view illustrating the nip member seen from a rubbed surface side.

As described above, the nip member 204 includes the nip forming portion 220 and the bent portion 210 (see FIG. 2). The nip forming portion 220 extends in the sheet conveyance direction, along the fixing nip portion N. The bent portion 210 is formed continuously with the downstream edge portion of the nip forming portion 220, and extends in the separation direction without being rubbed against the inner circumferential surface of the fixing belt 201. In addition, as illustrated in FIGS. 3 and 4, the bent portion 210 includes grooves M that serve as a holding portion, and that extend along the rotation-axis direction (indicated by an arrow X) of the pressing roller 202. In the present embodiment, the plurality of (three) grooves M are formed in parallel with each other, in a surface of the bent portion 210 that faces the inner circumferential surface of the fixing belt 201. One of the plurality of grooves M serves as a first holding member, and another of the plurality of grooves M serves as a second holding member. In addition, the plurality of grooves M extend in the rotation-axis direction of the pressing roller 202, and are arranged adjacent to each other in the separation direction in which the bent portion 210 extends. As one example, in a case where the thickness of the bent portion 210 is 1 mm, the depth and the separation-direction length of each of the grooves M is both about 10 μm.

Figure 5:
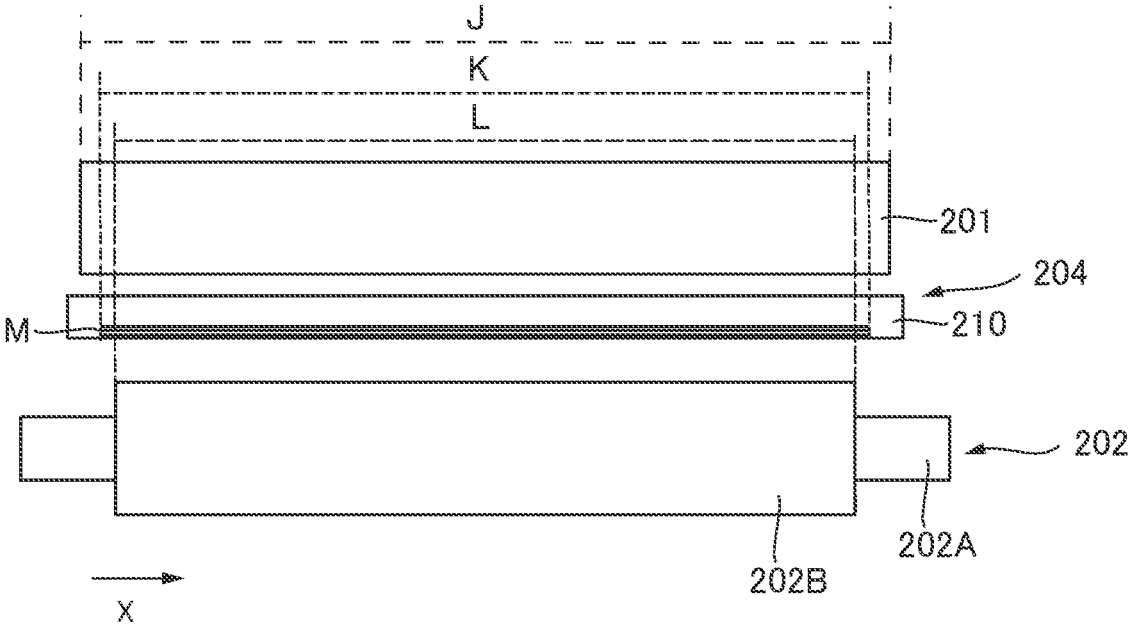
FIG. 5 is a schematic diagram for illustrating the length of a groove portion in the width direction.

As illustrated in FIG. 5, in the present embodiment, the fixing belt 201 is disposed in a first area J, the roller portion 202B of the pressing roller 202 is disposed in a second area L, and the grooves M are disposed in a third area K. In addition, in the rotation-axis direction (indicated by the arrow X) of the pressing roller 202, the third area K is within the first area J, and the second area L is within the third area K. Specifically, in the rotation-axis direction, the length of the fixing belt 201 is larger than the length of the roller portion 202B, the length of the nip member 204 is larger than the length of the fixing belt 201, and the length of the grooves M is larger than the length of the roller portion 202B and smaller than the length of the fixing belt 201. In addition, in the rotation-axis direction, an end portion of each of the grooves M is positioned between a corresponding end portion of the roller portion 202B and a corresponding end portion of the fixing belt 201. In other words, both end portions of each of the grooves M are positioned outside of the end portions of the roller portion 202B, and inside of the end portions of the fixing belt 201.

Figure 6:
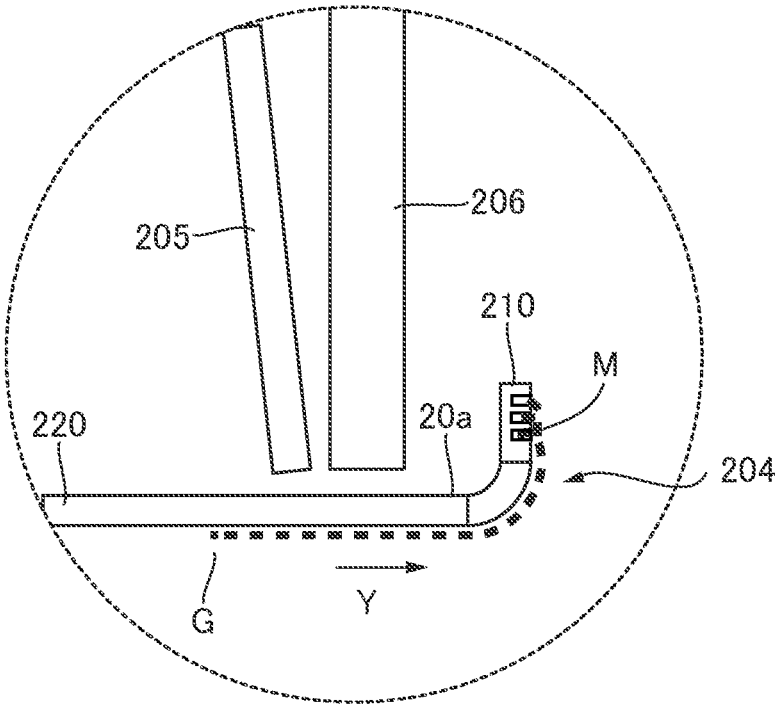
FIG. 6 is a diagram illustrating a flow of lubricant of the present embodiment.

As illustrated in FIG. 6, in the nip member 204 of the present embodiment, the grooves M hold the lubricant G (which flows downward in the sheet conveyance direction indicated by the arrow Y, separates from the inner circumferential surface of the fixing belt 201, and flows on the surface of the bent portion 210), and suppress the lubricant G from moving toward the reflective plate 205. The lubricant G that flows on the bent portion 210 moves along the grooves M in the rotation-axis direction of the pressing roller 202. Since the lubricant G does not flow around the leading edge of the bent portion 210, the lubricant G hardly reaches the heat receiving surface 20*a*. Thus, since the lubricant G hardly reaches the heat receiving surface 20*a*, on which side the reflective plate 205 and the nip member 204 are held by the stay 206, the lubricant G does not adhere to the reflective plate 205.

Figure 7:
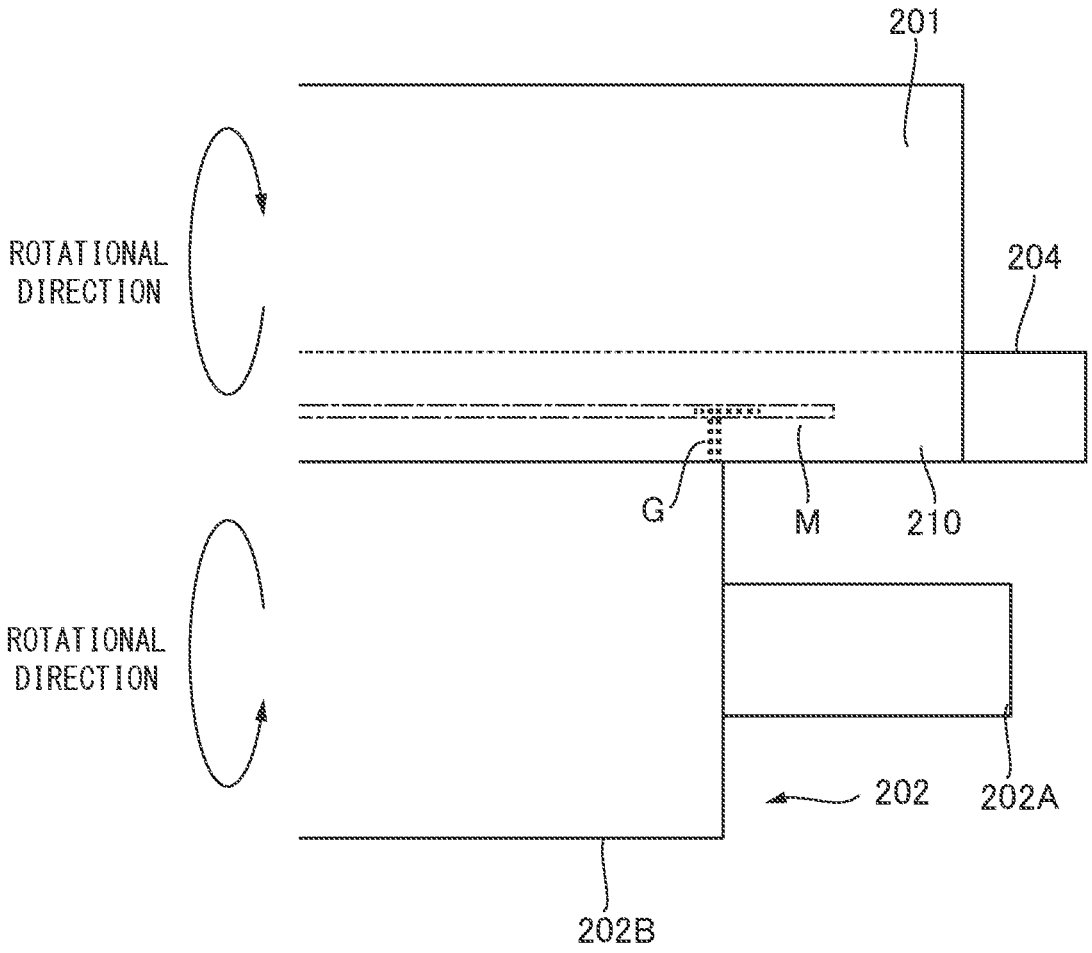
FIG. 7 is an enlarged schematic diagram for illustrating the flow of the lubricant.

As described above, the grooves M are formed such that both end portions of each of the grooves M are positioned outside of the end portions of the roller portion 202B of the pressing roller 202. Thus, as illustrated in FIG. 7, the lubricant G that flows on the surface of the bent portion 210 is reliably prevented from moving toward the reflection plate 205, by the grooves M. In addition, the grooves M are formed such that both end portions of each of the grooves M are positioned inside of the end portions of the fixing belt 201. Thus, the lubricant G that moves along the grooves M in the rotation-axis direction hardly flows around the end portions of the fixing belt 201 to the outer circumferential surface of the fixing belt 201. The lubricant G held by the grooves M returns to the inner circumferential surface of the rotating fixing belt 201, and moves together with the fixing belt 201, along the inner circumferential surface of the fixing belt 201. Note that a single groove M may be formed in the bent portion 210. However, the plurality of grooves M is preferably formed in the bent portion 210 for reliably preventing the lubricant G from moving toward the reflective plate 205.

As described above, in the present embodiment, the grooves M are formed in the bent portion 210, which extends in the separation direction without being rubbed against the inner circumferential surface of the fixing belt 201. Thus, even if the viscosity of the lubricant G decreases when the lubricant G is heated, and the lubricant G flows on the bent portion 210, the lubricant G is suppressed by the grooves M from flowing to the heat receiving surface 20*a*, on which side the reflective plate 205 and the nip member 204 are held by the stay 206. Since the lubricant G hardly reaches the reflective plate 205, the lubricant G is suppressed from adhering to the reflective plate 205.

Second Embodiment

Figure 8:
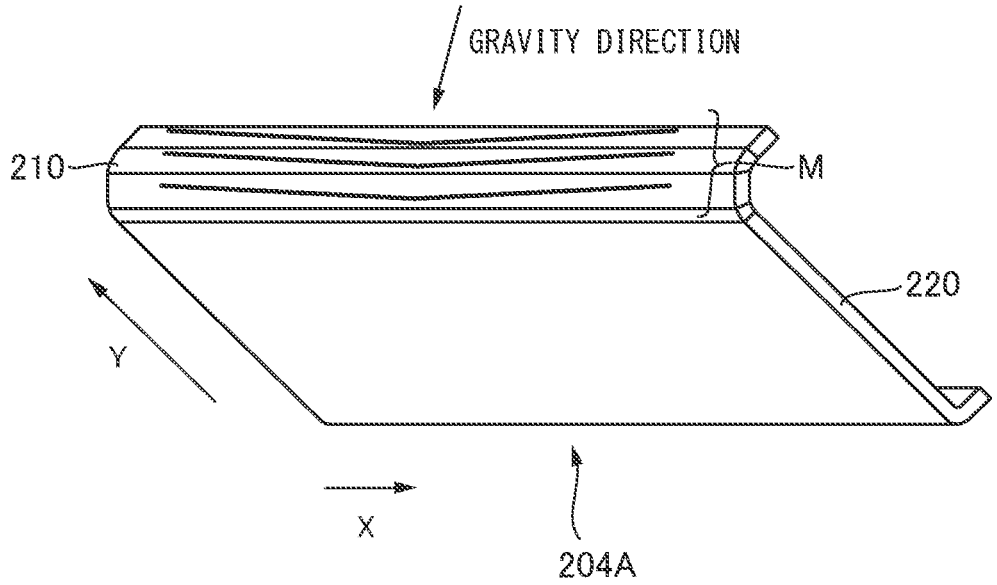
FIG. 8 is a perspective view illustrating a nip member of a second embodiment.

In the above-described nip member 204, the grooves M are formed, as an example, in the bent portion 210 so as to extend in the rotation-axis direction of the pressing roller 202, in parallel with each other (see FIG. 3). However, the present disclosure is not limited to this. For example, as in a nip member 204A illustrated in FIG. 8, the grooves M may be formed in the bent portion 210 such that the grooves M are inclined downward in the gravity direction from both end portions of the grooves M toward a center portion of the grooves M, when viewed in a direction orthogonal to the rotation-axis direction. In this case, the lubricant G held by the grooves M is easily collected in the center portion of the bent portion 210 by the gravitational force. Thus, the lubricant G that moves along the grooves M in the rotation-axis direction hardly flows around the end portions of the fixing belt 201 to the outer circumferential surface of the fixing belt 201.

Third Embodiment

Figure 9A:
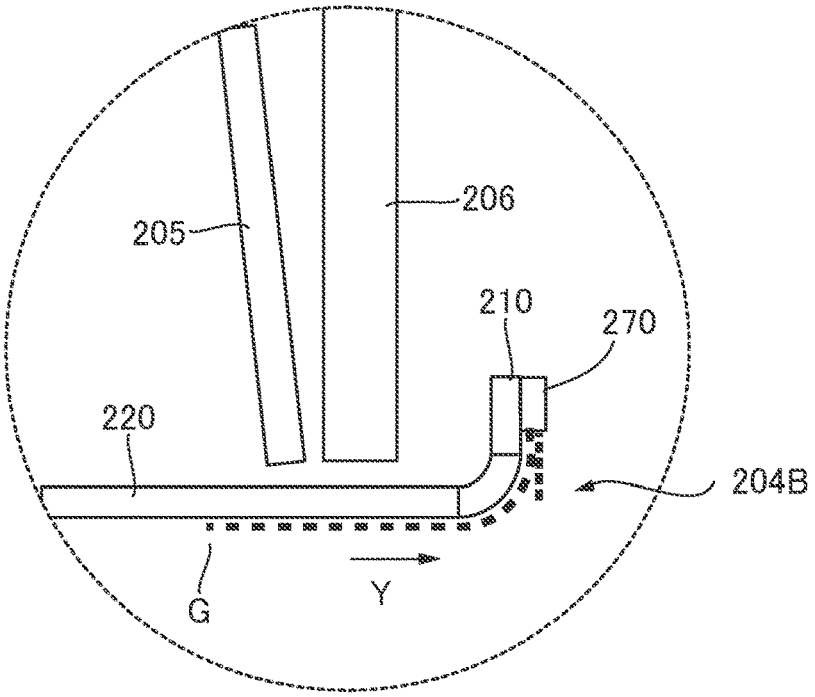
FIG. 9A is an enlarged view illustrating a nip member of a third embodiment, on which a single projection portion is formed.
Figure 9B:
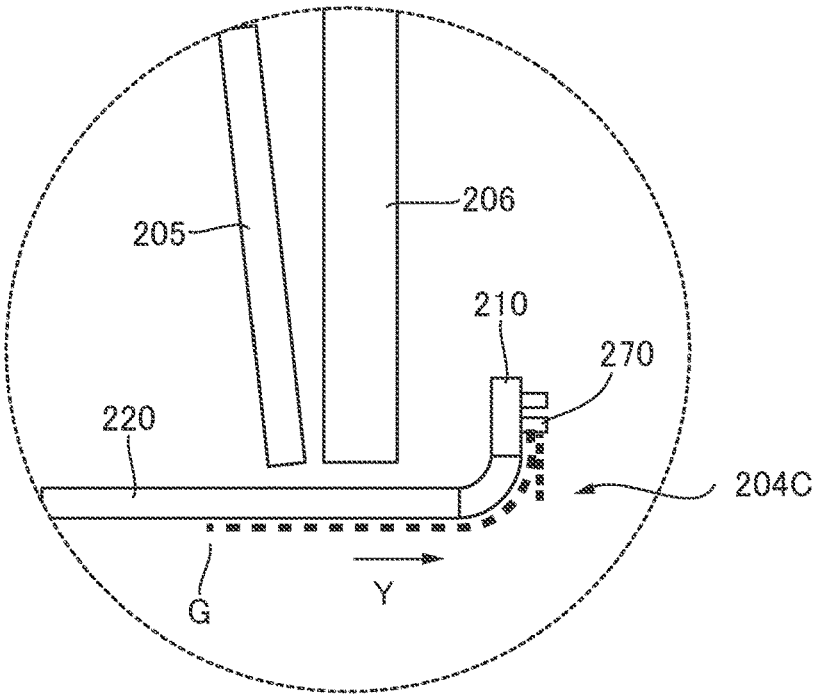
FIG. 9B is an enlarged view illustrating a nip member of the third embodiment, on which a plurality of projection portions is formed.

As in a nip member 204B illustrated in FIG. 9A or a nip member 204C illustrated in FIG. 9B, one or more projection portions 270 may be formed on the bent portion 210 in place of the grooves M, for suppressing the flow of the lubricant G that flows on the bent portion 210. As an example, the nip member 204B illustrated in FIG. 9A is provided with one projection portion 270, and the nip member 204C illustrated in FIG. 9B is provided with a plurality of projection portions 270. The length and shape of projection portions 270 may have the same length and shape of the above-described grooves M (see FIGS. 3, 5, and 8).

Other Embodiments

In the above-described embodiments, the grooves M or the projection portions 270 are formed on the surface of the bent portion 210, located on the same side as the rubbed surface 20*b* of the nip forming portion 220 is formed. However, the present disclosure is not limited to this. For example, the grooves M or the projection portions 270 may be formed on a surface of the bent portion 210 that is opposite to the rubbed surface 20*b* of the nip forming portion 220.

In the above-described embodiments, the halogen lamp (halogen heater) 203 is used as a heating element. However, the present disclosure is not limited to this. For example, the heating element may be another heater, such as an infrared heater or a carbon heater.

In the above-described embodiments, the description has been made as examples for the image forming apparatus 100 in which toner images having different colors are primary-transferred from the photosensitive drums 1Y to 1K onto the intermediate transfer belt 8, and then the resultant toner image having the different colors is collectively secondary-transferred onto the sheet S. However, the present disclosure is not limited to this. For example, the image forming apparatus may be a direct-transfer image forming apparatus in which the toner images having different colors are directly transferred from the photosensitive drums 1Y to 1K onto the sheet S.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-132529, filed Aug. 4, 2020, which is hereby incorporated by reference herein in its entirety.

What is claimed is:

1. A fixing apparatus comprising:

an endless first rotary member;

a heating element disposed inside the first rotary member;

a second rotary member configured to be in contact with an outer circumferential surface of the first rotary member, the second rotary member and the first rotary member being configured to form a nip portion through which a sheet is conveyed while nipped by the first rotary member and the second rotary member;

a nip member configured to be rubbed against an inner circumferential surface of the first rotary member via lubricant such that the first rotary member is nipped by the nip member and the second rotary member, the nip member being configured to receive radiant heat from the heating element and heat the nip portion; and a reflective plate formed so as to surround the heating element when viewed in a rotation-axis direction of the second rotary member, and configured to reflect the radiant heat from the heating element, toward the nip member, wherein the nip member comprises a nip forming portion configured to be in contact with the first rotary member, and an extending portion formed continuously with a downstream edge portion of the nip forming portion in a sheet conveyance direction in the nip portion and configured not to be in contact with the first rotary member, wherein the extending portion comprises a holding portion configured to hold the lubricant, wherein the first rotary member is longer than the second rotary member in the rotation-axis direction, and wherein the holding portion is longer than the second rotary member and shorter than the first rotary member in the rotation-axis direction, and when viewed in the sheet conveyance direction, both end portions of the holding portion are position outside of end portions of the second rotary member and inside of end portions of the first rotary member.

2. The fixing apparatus according to claim 1, wherein the reflective plate comprises a contact portion configured to be in contact with the nip member, and wherein the holding portion is configured to hold the lubricant and suppress the lubricant from moving toward the contact portion.

3. The fixing apparatus according to claim 1, wherein the holding portion is formed on a surface of the extending portion located on the same side as a surface rubbed against the first rotary member of the nip forming portion.

4. The fixing apparatus according to claim 1, wherein the holding portion extends in parallel to the rotation-axis direction.

5. The fixing apparatus according to claim 1, wherein the holding portion is inclined downward in a gravity direction from both end portions of the holding portion toward a center portion of the holding portion, when viewed in a direction orthogonal to the rotation-axis direction.

6. The fixing apparatus according to claim 1, wherein the holding portion is a first holding portion, and wherein the extending portion comprises:

the first holding portion, and a second holding portion disposed adjacent to the first holding portion in a separation direction extending away from the second rotary member, formed so as to extend along the rotation-axis direction, and configured to hold the lubricant and suppress the lubricant from moving along the extending portion.

7. The fixing apparatus according to claim 1, wherein the holding portion is a groove formed in the extending portion.

8. The fixing apparatus according to claim 1, wherein the holding portion is a projection portion formed on the extending portion.

9. The fixing apparatus according to claim 1, wherein the heating element is a halogen lamp.

10. An image forming apparatus comprising:

an image forming unit configured to form a toner image on a sheet; and the fixing apparatus according to claim 1 and configured to fix the toner image formed by the image forming unit, to the sheet.

* * * * *